United States Patent [19]

Hishida et al.

[11] 4,117,435

[45] Sep. 26, 1978

[54] FLAP-ARMATURE ELECTROMAGNET

[75] Inventors: Yukio Hishida; Yuichi Asai; Toshikatsu Kondo; Akira Asai, all of Nagoya; Atsuo Sakaida, Gifu; Chiaki Miyazawa, Nagoya, all of Japan

[73] Assignee: Brother Kogyo Kabushiki Kaisha, Nagoya, Japan

[21] Appl. No.: 801,999

[22] Filed: May 31, 1977

[30] Foreign Application Priority Data

Jun. 14, 1976 [JP] Japan ..... 51-77287[U]

[51] Int. Cl.[2] ..... H01F 7/08

[52] U.S. Cl. ..... 335/270; 335/274; 400/124

[58] Field of Search ..... 335/270, 271, 273, 274, 335/276; 197/1 R

[56] References Cited

U.S. PATENT DOCUMENTS 2,913,548 11/1959 Martin ..... 335/276

3,117,255 1/1964 Peterson ..... 335/276 X

FOREIGN PATENT DOCUMENTS 2,307,283 8/1974 Fed. Rep. of Germany ..... 335/274

*Primary Examiner*—George Harris

*Attorney, Agent, or Firm*—George B. Oujevolk

[57] ABSTRACT

A flap-armature electromagnet comprises a U-shaped yoke, a pole core, a coil, a flap-armature, a compression spring and a coil spring. The flap-armature is rockingly supported on the yoke by means of projections formed at the upper rear end of the yoke and notches formed at both sides of the flap-armature. Each end of the coil spring is connected to each of the projections for pressing the flap-armature on a rocking axis of the flap-armature.

4 Claims, 3 Drawing Figures

FLAP-ARMATURE ELECTROMAGNET

BACKGROUND OF THE INVENTION

This invention relates to a flap-armature electromagnet.

DESCRIPTION OF THE PRIOR ART

In the conventional flap-armature electromagnet, the flap-armature is rockingly supported on a yoke. Such a supporting arrangement hinders the operating function of the flap-armature. More particularly, since the rocking axis of the flap-armature with respect to the yoke is spaced by a predetermined interval from a supporting member for supporting the flap-armature to the yoke, the driving torque of the flap-armature must be large and yet an incorrect operation of the flap-armature takes place because the supporting member acts against the rotating operation of the flap-armature by the electomagnet as a moment of rotation in the opposite direction and does not perform a reliable supporting function.

In case the flap-armature electromagnet is utilized as the printing wire driving electromagnet of a wire printer, a large current is required to obtain sufficient printing pressure because of these defects, and particularly these defects cause the printing wire to incorrectly print.

OBJECTS OF THE INVENTION

It is an object of this invention to provide a flap-armature electromagnet which can reliably operate a flap-armature.

It is another object of this invention to provide a flap-armature electromagnet which can rapidly respond with certainty.

It is a further object of this invention to provide a flap-armature electromagnet which is compact and less expensive.

DETAILED DESCRIPTION OF THE INVENTION

Figure 1:
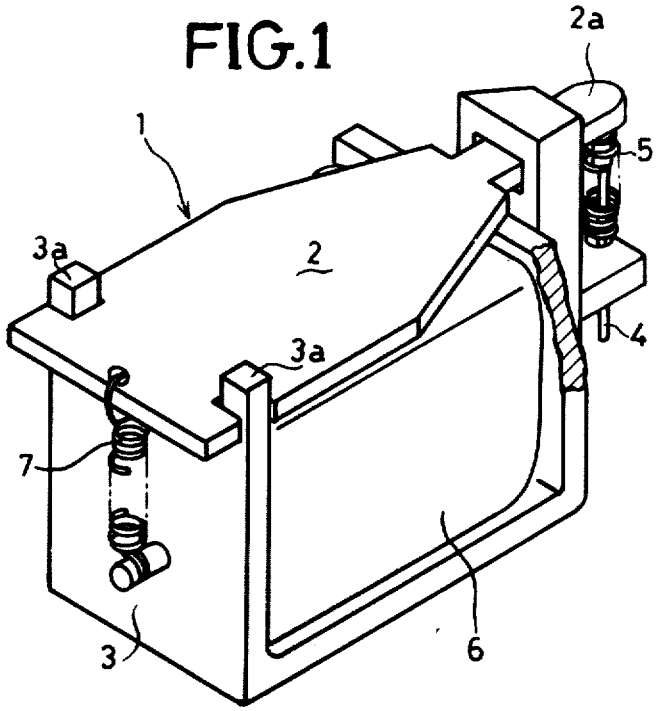
PRIOR ART FIG.1
FIG. 1 is a perspective view of a flap-armature electromagnet of the prior art.

FIG. 1 shows the conventional flap-armature electromagnet utilized for printing with a wire driving electromagent 1 of a wire printer. A flap-armature 2 is rockingly supported at one end thereof between supporting portions 3*a* and 3*a* projected from a yoke 3 and is formed at the other end thereof with an actuating portion 2*a* contacting the head of a printing wire 4. The actuating portion 2*a* is normally maintained in a non-operating position by a compression spring 5 coupled to the printing wire 4. The flap-armature 2 is rotated clockwise against the compression spring 5 when an excitation coil 6 is energized, to thus operate the printing wire 4. A coil spring 7 is provided at the center of one end of the flap-armature 2 to prevent the flap-armature 2 from erroneously operating.

More particularly, the flap-armature 2 is so supported rockingly between the supporting portions 3*a* and 3*a* of the yoke so as to restrict the horizontal motion thereof but is partly restricted in the vertical motion thereof by the coil spring 7.

However, the coil spring 7 is mounted at a position spaced by predetermined intervals from the rocking axis with respect to the flap-armature 2 as shown in FIG. 1 to provide a counterclockwise rotating moment always against the flap-armature 2. Accordingly, this moment becomes an excessive load when the excitation coil 6 is energized to operate the flap-armature 2 and thus increases the load of the excitation coil 6. Further, as the coil spring 7 is attached to the center of one end of the flap-armature 2, elevational motion of the flap-armature 2 in a wide direction tends to occur to cause the flap-armature 2 to erroneously operate.

Figure 3:
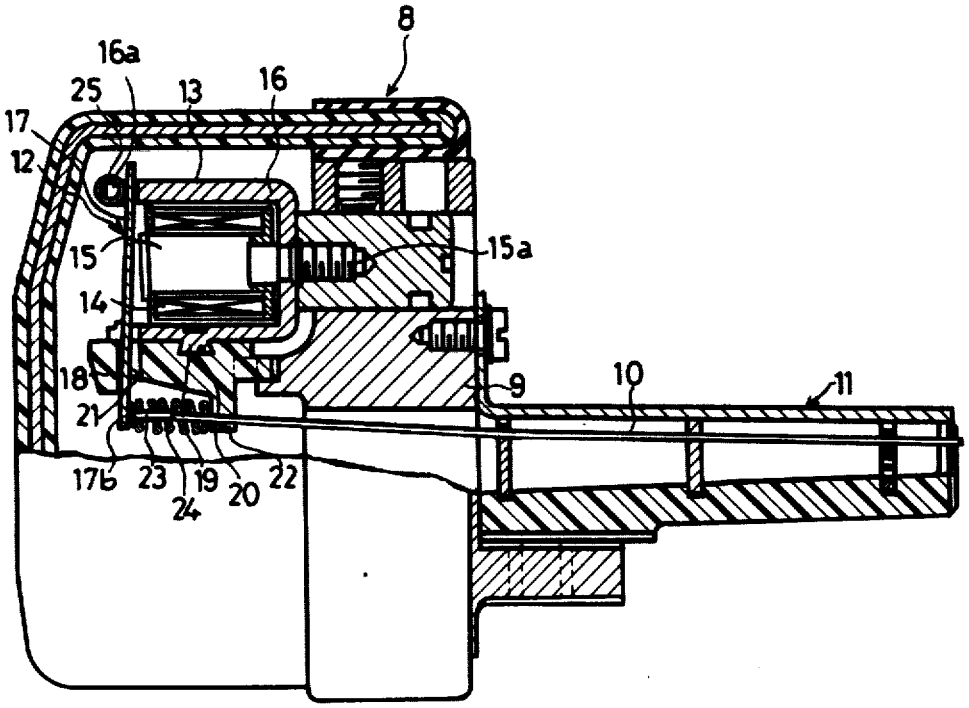
FIG. 3 is a front partially sectional view of a printing head assembly and the flap-armature electromagnet of the invention.

FIG. 3 shows a wire printer printing head 8 employing a flap-armature electromagnet constructed according to this invention. Seven printing elements 12 each having a flap-armature electromagnet 13 (only one element 12 is designated in FIG. 3) are mounted on one planar surface of a base 9 for a printing head in such a manner that each printing wire 10 is concentrated to one line by a printing wire guide 11.

The flap-armature electromagnet 13 used for the printing elements 12 of this printing head 8 will now be described in detail.

The flap-armature electromagnet 13 is secured to the front end 15*a* of an iron core 15 wound with a coil 14 thereon with a substantially U-shaped yoke 16 surrounding the coil 14. A flap-armature 17 (FIG. 2) has notches 17*a* formed at both sides of the base ends thereof and an actuating portion 17*b* formed in narrow width at the other end thereof. These notches 17*a* and 17*a* thus formed at the base ends of the flap-armature 17 are engaged with projections 16*a* formed at the upper rear end of the yoke 16 so that the flap-armature 17 is supported on the yoke 16. Thus, the flap-armature is rockingly supported at the engaging points of the projections 16*a* and 16*a* with the notches 17*a* and 17*a* as a center while restricting the horizontal motion thereof. A synthetic resin auxiliary frame 18 is mounted on the yoke 16 by engaging the dove-tail shape projection 19 projecting from yoke 16 with a dove-tail shape groove 20 formed in the frame 18. A penetrating hole 21 is formed at one end of the frame 18, and the actuating portion 17*b* of the flap-armature 17 is movably inserted through the hole 21 of the frame 18. A supporting portion 22 projects downwards in FIG. 3 from the frame 18, and the printing wire 10 is slidably supported at the portion 22. A boss 23 is fixed to the head of the printing wire 10 in such a manner that a compression spring 24 is interposed between the boss 23 and the supporting portion 22. This spring 24 urges the printing wire 10 to the left in FIG. 3 and also urges the actuating portion 17*b* of the flap-armature 17 to the left in FIG. 3.

Figure 2:
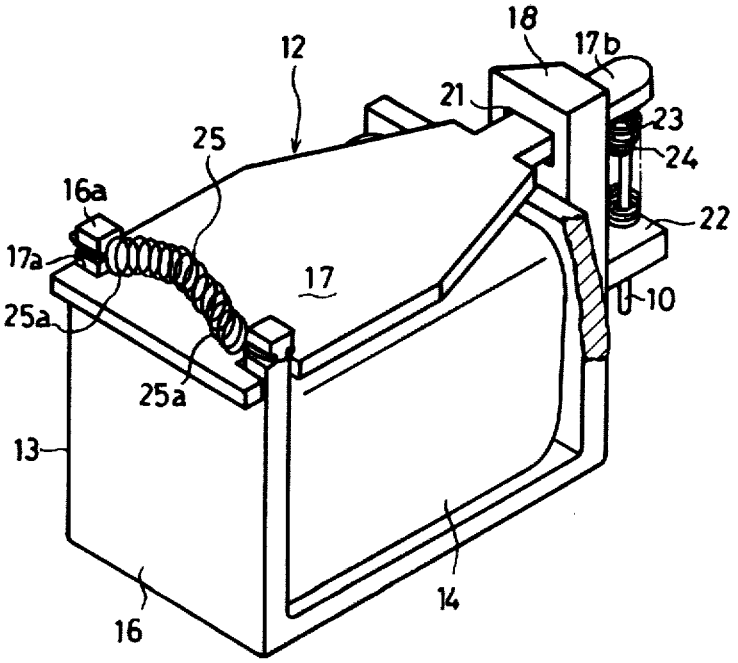
FIG. 2 is a perspective view of a flap-armature electromagnet of the invention.

Coil spring 25 is interposed and tensioned between the projections 16*a* of the yoke in such a manner that is forcibly raised upwardly at the center thereof so as to press both sides of the flap-armature 17 only at both ends 25*a* of the spring 25 as shown in FIG. 2. In addition, this spring 25 is so tensioned as to bias the rocking axis of the flap-armature 17 formed upon engagement of the notches 17*a* of the flap-armature 17 with the projections 16*a* of the yoke 16.

Since the spring 25 is thus tensioned, the flap-armature 17 does not sense the rotating moment created by the spring 25 at all, and the elevational motion of the flap-armature 17 in the lateral direction is completely prevented to thus prevent the flap-armature 17 from erroneously operating.

More particularly, when the coil 14 of the flap-armature electromagnet 13 is energized, the flap-armature 17 will rotate counterclockwise in FIG. 3 against the compression spring 24, whereupon the spring 25 will not affect the rocking motion of the flap-armature 17 at all. Accordingly, the flap-armature 17 can easily rotate against only the compression spring 24. If the coil of the flap-armature electromagnet 13 is deenergized, the flap-armature 17 is returned to the original position before rotation in accordance with the recoiling force of the compression spring 24. Further, even if this coil 14 is rapidly energized or deenergized cyclically, the flap-armature 17 will certainly follow the operations to completely prevent the flap-armature 17 from erroneously operating by means of the action of the spring 25.

It should be understood from the foregoing description that since this invention restricts both sides of the flap-armature at the rocking axis by the coil spring in structure for prohibiting excessive rotating moment to the flap-armature, the flap-armature electromagnet will completely prevent the flap-armature from erroneously operating. It should also be understood that this invention also provides extremely easy attachment and detachment of the coil spring making this invention very useful.

We claim:

1. A flap-armature electromagnet comprising (a) a U-shaped yoke (16) having a bottom portion and two side portions;

(b) a pole core (15) secured to the bottom portion of said U-shaped yoke;

(c) a coil (14) wound on said pole core (15);

(d) projecting means defining a rocking axis provided at the top surface of one of said two side portions;

(e) a flap-armature (17) having a first end portion (**17*b*) extending beyond said pole core and the top surface of the other of said two side portions, and an opposite second end portion extending to the top surface of the one of said two side portions, the first end portion of said flap-armature being movable toward and away from said pole core (15**);

(f) notch means (**17*a***) formed at the opposite second end portion of said flap-armature being engageable with said projecting means for rockingly supporting said flap-armature;

(g) a spring (25) positioned to hold the opposite second end portion of said flap-armature on the top surface of one of said two side portions by pressing the notch means on the rocking axis of said flap-armature; and, (h) resilient means (24) for urging the first end portion of said flap-armature away from said pole core.

2. A flap-armature electromagnet as set forth in claim 1 wherein said projecting means includes two projections projecting from both sides of the top surface of one side portion, and said notch means includes two notches formed at the opposite second end portion of said flap-armature.

3. A flap-armature electromagnet as set forth in claim 2 wherein said spring is a coil spring with two ends, and each end of said coil spring is connected to each of said projections so that said coil spring presses at least both end parts of the second end portion of said flap-armature.

4. A flap-armature electro-magnet comprising:

(a) a yoke (16) having a U-shaped cross-section with a bottom portion and front and rear sides with top surfaces, a pole core (15) with a front end secured to said bottom portion having a coil (14) wound on said core (15);

(b) a pair of rear projecting means provided at opposed parts of the top surface of said rear side said projecting means defining a rocking axis;

(c) a flap-armature (17) having a front end section (**17*b*) extending beyond said pole core front end and the top surface of said front side, said front end being movable towards and away from said pole core (15) and a rear section extending to the top surface of said rear side, said rear section having opposed notch means (17*a***) engagable with said opposed projecting means for rockingly supporting said flap-armature;

(d) a spring (25) positioned to press said notch means on said defined rocking axis; and, (e) resilient means (24) urging the first end portion of said flap-armature away from said pole core.

* * * * *